US007097605B2

(12) United States Patent
Zaoralek

(10) Patent No.: US 7,097,605 B2
(45) Date of Patent: Aug. 29, 2006

(54) ROLLER FOR THE THERMOMECHANICAL TREATMENT OF A WEB-SHAPED MEDIUM

(75) Inventor: Heinz-Michael Zaoralek, Köngisbronn (DE)

(73) Assignee: SHW Casting Technologies GmbH, Aalen-Wasseralfingen (DE)

( * ) Notice: Subject to any disclaimer, the term of this patent is extended or adjusted under 35 U.S.C. 154(b) by 211 days.

(21) Appl. No.: 10/651,321

(22) Filed: Aug. 28, 2003

(65) Prior Publication Data

US 2004/0132596 A1 Jul. 8, 2004

(30) Foreign Application Priority Data

Aug. 28, 2002 (DE) ..... 102 39 559

(51) Int. Cl.
*F28F 5/02* (2006.01)
*F28D 11/02* (2006.01)

(52) U.S. Cl. ..... 492/46; 492/20; 165/89; 165/90

(58) Field of Classification Search ..... 492/46, 492/20; 165/89, 90
See application file for complete search history.

(56) References Cited

U.S. PATENT DOCUMENTS

| | | | | |
|---|---|---|---|---|
| 1,279,264 | A | 9/1918 | Clinton | |
| 2,531,988 | A | 11/1950 | Price | |
| 3,834,205 | A | 9/1974 | Maag et al. | |
| 5,655,596 | A | 8/1997 | Zaoralek | |
| 5,725,466 | A | 3/1998 | Eppli et al. | |
| 5,887,644 | A * | 3/1999 | Akiyoshi et al. | 164/428 |
| 6,039,681 | A | 3/2000 | Heinz-Michael | |
| 6,460,611 | B1 | 10/2002 | Zaoralek | |
| 2002/0029870 | A1 | 3/2002 | Schweinichen | |

FOREIGN PATENT DOCUMENTS

| | | |
|---|---|---|
| DE | 1 811 690 | 7/1970 |
| DE | 2 363 063 | 7/1974 |
| DE | 40 36 121 A1 | 1/1992 |
| DE | 44 04 922 C2 | 9/1995 |
| DE | 44 07 239 A1 | 9/1995 |
| DE | 195 38 236 A1 | 4/1997 |
| DE | 200 11 530 U1 | 4/2001 |
| DE | 199 57 847 C1 | 6/2001 |
| DE | 100 17 604 A1 | 10/2001 |
| EP | 0 950 760 A1 | 10/1999 |
| EP | 1 302 682 A1 | 4/2003 |
| WO | WO-02/095249 A1 | 11/2002 |

* cited by examiner

*Primary Examiner*—Marc Jimenez
(74) *Attorney, Agent, or Firm*—RatnerPrestia

(57) ABSTRACT

The present invention relates to a roller for the thermomechanical treatment of a web-shaped medium, the roller including: a roller body; axial bores for a thermal treatment fluid which are incorporated in roller body near to an outer surface of the roller body and into which the thermal treatment fluid flows on an inflow side; inflow zones, formed on the inflow side in the upstream ends of the bores or in feed channels through which the thermal treatment fluid flows into the bores; and directing or guiding portions provided in the inflow zones, which transfer a rotational movement of the roller onto the thermal treatment fluid, the directing portions at least substantially completely transfer the rotational movement onto the thermal treatment fluid and in this way suppress a relative swirl between the bores and the thermal treatment fluid, while still in the inflow zones.

9 Claims, 3 Drawing Sheets

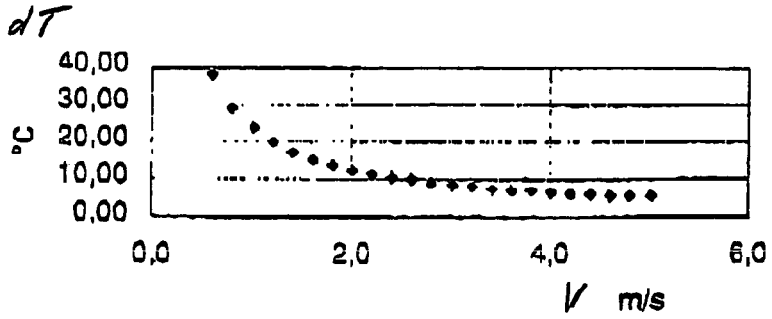
Fig. 1
Fig. 2
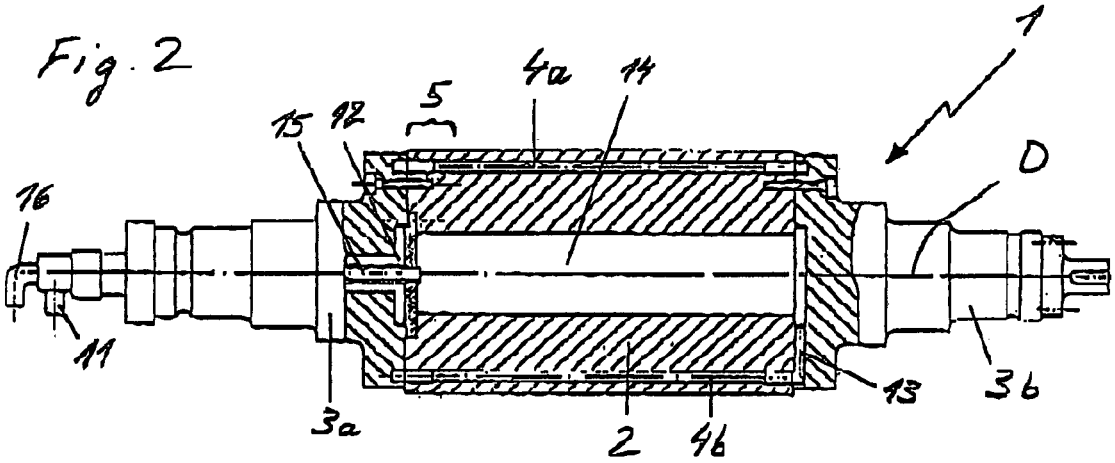
Fig. 3
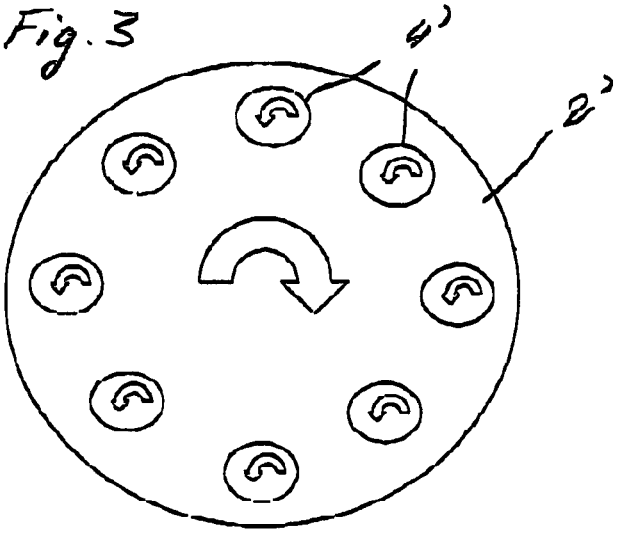
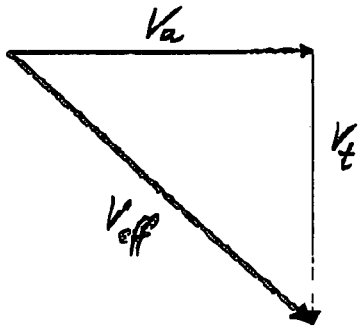
Fig. 4

ROLLER FOR THE THERMOMECHANICAL TREATMENT OF A WEB-SHAPED MEDIUM

BACKGROUND OF THE INVENTION

1. Technical Field

The invention relates to the fluidic thermalization, i.e. heating and cooling, of a roller for the thermomechanical treatment of a web-shaped medium.

2. Description of the Related Art

A thermal treatment fluid, for example a thermal oil, flows through the roller body in near-surface, axially parallel bores. In order to ensure that the rollers are heated as uniformly as possible, the flow velocity of the thermal treatment fluid in the bores is influenced. Examples of such measures are described in DE 40 36 121 A1. These utilize the fact that the transfer of heat from the thermal treatment fluid to the wall of the bore and therefore to the roller body is dependent on the velocity of the thermal treatment fluid relative to the wall of the bore. Even when the thermal treatment fluid has a turbulent flow in the cross-section of the bore, the thermal treatment fluid is slowed down by friction directly on the wall of the bore, enough for a thin layer of laminar flow to be formed on the wall, which acts as a barrier for the transfer of heat from the thermal treatment fluid to the wall of the bore. A temperature difference arises between the mean temperature of the thermal treatment fluid in the cross-section of the bore and the temperature of the wall of the bore. In the case of a heating fluid, this is a drop in temperature, i.e. the heating fluid is warmer than the wall. In otherwise identical conditions, the higher the flow velocity of the thermal treatment fluid, the thinner the laminar layer near the wall and therefore the lower the temperature difference. The drop in temperature is therefore counteracted by a corresponding increase in the flow velocity.

DE 200 11 530 U1 aims to equalize the temperature distribution on the surface of a roller using a nested arrangement of outward flow and return flow channels. One outward flow channel and one return flow channel is formed in each of the peripheral bores of the roller body, such that the thermal treatment fluid is guided in each of the bores in the counter flow. Equalizing the heat between the outward flowing and return flowing thermal treatment fluid reduces the temperature differences in the roller body.

SUMMARY OF THE INVENTION

It is an object of the invention to equalize the temperature distribution on the outer surface of a fluidically heated or cooled roller for the thermomechanical treatment of a web-shaped medium.

The invention relates to a roller for the thermomechanical treatment of a web-shaped medium, said roller comprising peripheral bores for a thermal treatment fluid in a roller body. The bores extend axially, preferably axially and in parallel with a rotational axis of the roller. They can in particular, as is usual, be circular in their cross-section. The thermal treatment fluid is preferably a liquid and can in particular be a thermal oil. In general, the thermal treatment fluid serves to heat the roller body and in such applications is referred to as a heating fluid. On the other hand, however, the thermal treatment fluid can also be a cooling fluid serving to cool the roller body.

In accordance with the invention, directing or guiding means are provided in inflow zones through which the thermal treatment fluid flows, on an inflow side on which the thermal treatment fluid flows into the bores or into a portion of the bores only, said directing means transferring a rotational movement of the roller onto the thermal treatment fluid, for the thermal treatment fluid flowing in initially has no rotational impulse itself. Using the measure in accordance with the invention, the relative channel swirl is already suppressed in the inflow zones, by impressing the rotational movement of the roller on the thermal treatment fluid in the inflow zones. Ideally, the relative rotational movement between the thermal treatment fluid and the respective bore into which the thermal treatment fluid is flowing is completely or at least substantially completely suppressed while still within the inflow zone associated with the bore, i.e. the rotational movement of the roller, or more precisely of the bore, is completely or at least substantially completely transferred while still in the inflow zone. At least substantially completely suppressing the relative rotational movement, i.e. transferring the rotational movement, means that the relative rotational movement is sufficiently eliminated while still in the inflow zone that a relative rotational movement such as may still remain is in practice no longer relevant for the uniformity of the temperature distribution in the longitudinal direction of the bore.

In order to achieve this, the directing or guiding means include directing or guiding elements which only extend over the length of the inflow zones in the flow direction of the thermal treatment fluid and protrude into the flow of the thermal treatment fluid, in order to suppress the channel swirl directly in the inflow zones. The directing elements act counter to the direction of the relative rotational movement which occurs between the roller and the thermal treatment fluid upstream of the inflow zones, as impact bodies for the thermal treatment fluid flowing in. The relative channel swirl can also be counteracted by shaping feed channels in a particular way, in which the walls of the bores of the inflow side within the inflow zone of the respective bore each assume the function of an impact body. This is also understood as a directing means in the sense of the invention if it at least substantially suppresses the rotational impulse while still in the respective inflow zone.

The inflow zones, which can only be formed in the peripheral bores or only in the feed channels to the peripheral bores or in the transfer region from the feeds to the peripheral bores, preferably extend in the flow direction over at most up to 20%, more preferably over at most up to 10%, of the overall lengths of the bores, and are advantageously even shorter.

In preferred embodiments, the directing means terminate within the upstream end regions of the bores. The length of each of the directing means, measured in the longitudinal direction of the bores or feed channels, should in each case be at least twice as large as the width, measured radially with respect to the longitudinal direction. On the other hand, a length of at most a hundred times or at most fifty times the diameter of the bore should be sufficient, wherein when the cross-section of a bore deviates from the circular cross-section, the largest diameter of the bore in question is to be taken as the basis.

Once it has flowed through the inflow zones, the thermal treatment fluid enters the free flow cross-section of the bores. It is perfectly possible to form displacement means in the bores, downstream of the inflow zones in accordance with the invention, in order for example to specifically influence the axial flow velocity of the thermal treatment fluid in the subsequent run of the bores. If such measures are taken, the flow velocity is to be increased in this way, in order to compensate for the decrease in the temperature difference between the thermal treatment fluid and the roller by increasing the axial flow velocity. In any event, the thermal treatment fluid no longer exhibits any or any practically relevant rotational velocity relative to the surrounding wall of the bore as it is transferred from the respective inflow zone to the adjoining flow cross-section of the bore in question.

As a result, the invention overcomes an effect which counteracts an equalization of the temperature. It assists in equalization and can also be usefully employed in combination with measures for accelerating flow, such as are described for example in DE 40 36 121 A1.

The inflow zones with the directing means should be formed as close as possible before or in the upstream ends of the bores. In a preferred embodiment, the directing means are formed in the peripheral bores or only in a number of the peripheral bores. If a number of bores, for example two or three bores, are connected in series and the thermal treatment fluid correspondingly flows through them one after the other, it is sufficient if the rotational impulse transfer in accordance with the invention is ensured in or before the bore of the bores connected in series which the thermal treatment fluid first flows through, in their upstream inflow zone.

The directing means and/or inflow zones can also be formed upstream, i.e. before the bores with respect to the flow. In this way, the directing means can also be formed in a trunnion flange of the roller, in feed channels through which the thermal treatment fluid is fed to the thermal treatment channels, providing the feed channels run axially or obliquely before the bores, with a substantial axial component.

If the inflow zones provided with the directing means are formed in the feed channels for the bores or, as is preferred, in the bores themselves, then in a preferred embodiment at least one directing element acting as an impact body is provided in each of the feed channels or/and each of the bores of the inflow side of the roller. Advantageously, the directing means offers the flow of the thermal treatment fluid as little resistance as possible in the translational direction. The at least one directing element or the number of directing elements of each of the directing means therefore preferably extend(s) substantially only in the translational direction of the flow and therefore perpendicularly to the rotational direction of the relative rotational movement. Particularly preferably, they extend in the longitudinal direction of the bores and/or feed channels, in order to keep the flow resistance in the axial direction as low as possible. Preferably, each directing element of the directing means exhibits a smooth surface, in order to keep the wall friction which counteracts the translational component of the flow velocity as low as possible. This aim is accommodated if the directing element or the number of directing elements is/are each formed by a slender peen. Such a peen can protrude into or completely through the flow cross-section from a wall of a feed channel or preferably a wall of a bore. Such a peen exhibits a width which, measured radially with respect to the respective bore, preferably measures at least 30% of the diameter of the bore. The peen or number of peens per bore preferably protrude(s) into the bore in question or, as the case may be, into the associated feed channel exactly radially or at least substantially radially with respect to the longitudinal axis of its/their bore, in order to transfer the rotational impulse and therefore consequently suppress the channel swirl as completely as possible over as short an axial length as possible.

The peens or peen-like directing means split the flow in each of the inflow zones, i.e. they act as flow splitters.

Further preferred embodiments of the invention are also described in the sub-claims.

BRIEF DESCRIPTION OF THE DRAWINGS

The invention will now be explained by way of example embodiments. Features disclosed in the example embodiments, each individually and in any combination of features, advantageously develop the subjects of the claims. There is shown:

FIG. 1 a plot of the drop in temperature between a heating fluid and a wall of a bore, depending on the flow velocity of the heating fluid;

FIG. 2 a thermally treated roller in a partial longitudinal section;

FIG. 3 the relative channel swirl;

FIG. 4 a velocity diagram for in-flowing thermal treatment fluid with relative channel swirl;

DETAILED DESCRIPTION

Figures 5, 6, 7:
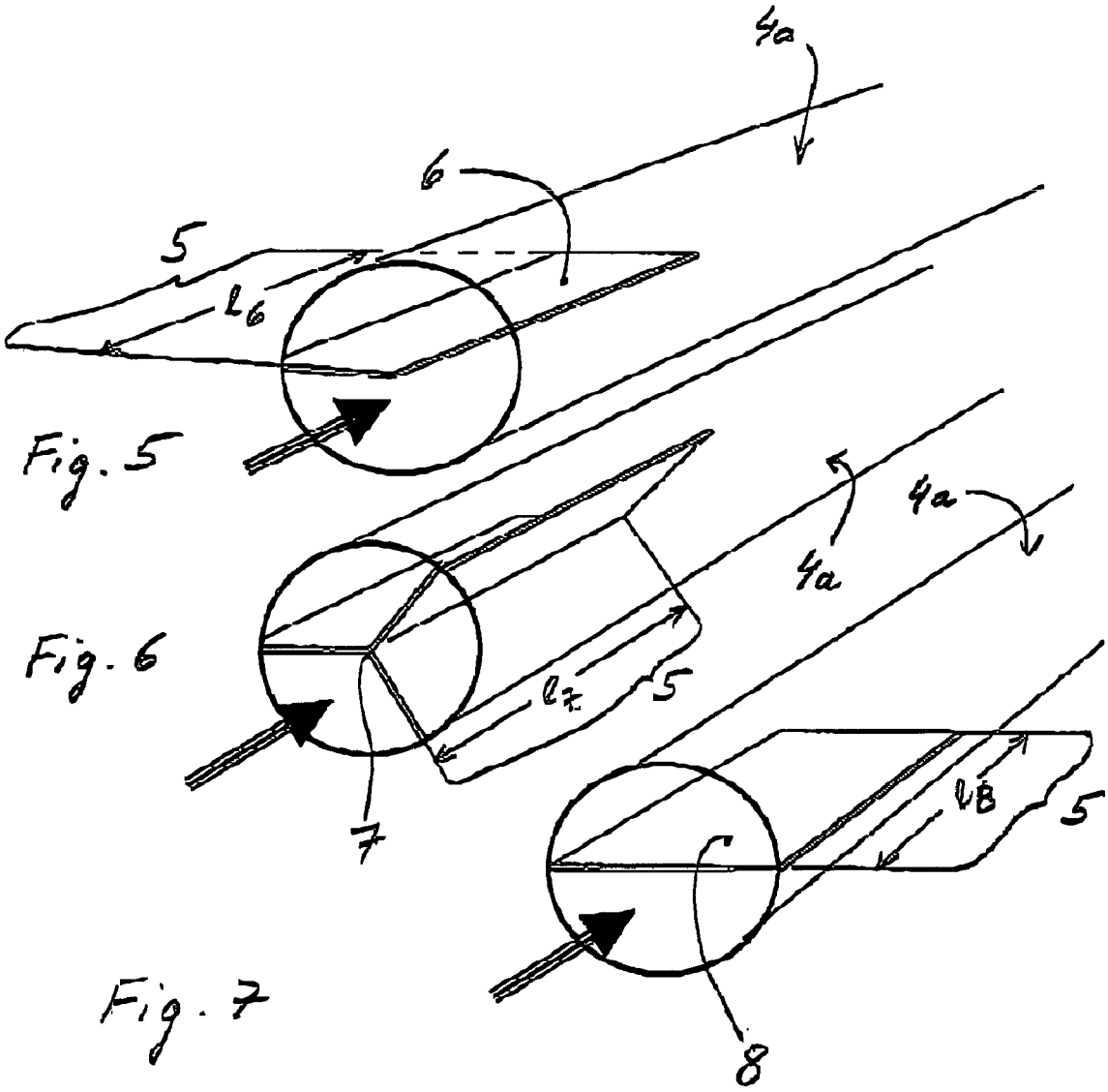
FIG. 5 an inflow zone of a peripheral bore with a directing element inserted, in accordance with a first example embodiment.
FIG. 6 an inflow zone of a peripheral bore with a directing element inserted, in accordance with a second example embodiment.
FIG. 7 an inflow zone of a peripheral bore with a directing element inserted, in accordance with a third example embodiment.

FIG. 1 shows by way of an example how the drop in temperature dT from the mean temperature of a heating fluid to the temperature of the wall of the bore, in given conditions, is dependent on the flow velocity v of the heating fluid. In the example shown, the thermal oil Mobilterm603 is used as the heating fluid. A circular bore having a uniform diameter of 32 mm over its entire length is assumed for the bore. The mean temperature of the heating fluid is 230° C. The drop in temperature dT is shown for a transfer of energy of 2.5 kW/m of the bore. The relationship between the drop in temperature dT and the flow velocity v shown by way of the example is used in the prior art to counteract the drop in temperature which the thermal treatment fluid experiences during operation as it flows through the roller. If one assumes in the example shown that the flow velocity v is 1.4 m/s as the fluid enters the bore, then according to the usual formulae for transfer of heat at a Reynold's number of 42,000, a drop in temperature dT of 17° C. may be calculated. If the flow velocity v is doubled to 2.8 m/s, the Reynold's number is also doubled and the drop in temperature dT from the thermal treatment fluid to the wall of the bore is then only 9° C. By incrementally raising the flow velocity v by means of inserts which reduce the cross-section, such as are described in DE 40 36 121 A1, a drop in temperature up to 8° C. can be equalized.

FIG. 2 shows a roller with a roller surface which is brought to and held at a certain temperature, for example a heating roller, for manufacturing or treating material webs, such as for example paper webs. The roller as a whole is indicated by the reference numeral 1. The roller 1 comprises a roller body 2 and, on each of the two facing sides of the roller body 2, a screwed-on flange trunnion 3*a* and 3*b*. The flange trunnions 3*a* and 3*b* serve on the one hand to rotationally mount the roller body 2 and on the other to feed, drain and distribute a thermal treatment fluid. In the example embodiment, this is a heat transfer liquid, preferably a thermal oil. The thermal treatment fluid is fed through the flange trunnion 3*a* via a feed 11. The feed 11 branches into a plurality of feed channels 12 while still in the flange trunnion 3*a,* said feed channels 12 feeding onto the facing side of the flange trunnion 3*a* facing the roller body 2, near to the outer surface of the roller body 2.

Near-surface bores extend through the roller body 2, parallel to the rotational axis D of the roller 1 and evenly distributed about the rotational axis D, and feed onto both facing sides of the roller body 2. The feed channels 12 feed directly into a first group of bores, indicated by 4*a*. Each of the bores 4*a* forms a first bore of a total of three bores in each case, connected in series, through which the thermal treatment fluid flows one after the other. The second and third bores in each group of three bores are indicated by 4*b*. The flow is shaped such that the thermal treatment fluid flows through the central feed 11 and the feed channels 12 branching off from it, into the first bores 4*a*. From the first bores 4*a,* the thermal treatment fluid flows via connecting channels formed in the trunnion flange 3*b* into the second bores 4*b,* flows in the second bores 4*b* back to the trunnion flange 3*a* and is directed or guided via connecting channels formed there, extended in the circumferential direction, into the third bores 4*b*. One of the third bores 4*b* may be seen in the section in FIG. 2. The third bores 4*b* are connected via radial connecting channels 13 to a central hollow space 14 of the roller body 2. The thermal treatment fluid thus flows through the first bores 4*a,* the adjoining second bores 4*b* and lastly the adjoining third bores 4*b,* one after the other, until it flows into the central hollow space 14. The thermal treatment fluid passes from the central hollow space 14, via a drainage channel 15 extending through the trunnion flange 3*a,* as far as a drain 16. The drained thermal treatment fluid is reheated and re-fed via the feed 11.

In each group of bores 4*a* and 4*b* which the fluid flows through sequentially one after the other, a specific inflow zone 5 is formed at each upstream end of the bores 4*a* through which the fluid flows first. In accordance with the invention, a directing means is arranged in the inflow zone 5, said directing means causing the rotational impulse of the rotating bores 4*a*, originating from the relative rotational movement, to be transferred along the axial length of the inflow zone 5, partially or preferably at least substantially completely onto the thermal treatment fluid flowing in, and therefore the relative channel swirl to be suppressed while still in the inflow zone 5.

FIG. 3 schematically shows, in a facing view onto the inflow side of a roller body 2', the relative channel swirl for conventional rollers, i.e. for rollers without a directing means in the inflow zone. The rotational movement of the roller is indicated by the central rotating arrow. Because of the rotational movement of the roller body 2', the bores 4' exhibit a rotational component relative to the thermal treatment fluid flowing in. The thermal treatment fluid flowing in correspondingly performs a rotational movement in the opposite direction in the bores 4', indicated for each of the bores 4' by a corresponding rotating arrow. The person skilled in the art calls this a relative channel swirl. Only as the fluid flows through the bores 4' is a rotational movement in the flow of the fluid gradually induced by the wall friction.

With respect to the wall of the bore, the thermal treatment fluid has, alongside its axial velocity component which follows from the volume flow, an additional circumferential component at the beginning of the respective bore 4'. The flow velocity of the thermal treatment fluid relative to the wall of the bore is given by the vector diagram shown in FIG. 4. In the vector diagram, the axial velocity component is indicated by $v_a$ and the circumferential component by $v_t$. Adding the vectors of the two velocity components $v_a$ and $v_t$ gives, in a known way, the resultant flow velocity $v_{eff}$ which the thermal treatment fluid exhibits relative to the wall of the bore. In accordance with the relationship shown as an example in FIG. 1, the roller body 2' is therefore heated more strongly on its inflow side than as a result of the axial velocity component $v_a$ of the thermal treatment fluid alone. If the roller 1 rotates for example at eleven revolutions per second, and the roller body 2' has a diameter of 812 mm and the circular bores 4' each have a diameter of 32 mm, then at an operational velocity of the roller of 1,680 m/min the circumferential component $v_t$ of the flow velocity comes out at 1.1 m/s. In accordance with Pythagoras' theorem, and given for example an axial velocity component $v_a$ of 1.4 m/s, a resultant relative velocity $v_{eff}$ of the thermal treatment fluid of 1.78 m/s may be calculated. In accordance with the diagram in FIG. 1, increasing the relative velocity by 0.38 m/s results in an increase in the temperature of the walls of the bores 4' by 3.5° C. as compared to a purely translational flow having $v_a$=1.4 m/s. This effect wears off with increasing inflow depth and generates an increase in temperature in the roller body 2', increasing toward the inflow side, and also an undesired increase in the diameter of the roller body 2' on its outer surface and consequently on the inflow side.

In accordance with the invention, the relative channel swirl is suppressed—as already mentioned with respect to the roller in FIG. 2—by forming a directing means for the thermal treatment fluid in each of the inflow zones 5. The directing means are formed by directing elements provided in the first bores 4*a* on the inflow side, i.e. in the upstream inflow sections of the bores 4*a*.

FIGS. 5, 6 and 7 each show one example embodiment for a directing element of the directing means. Such a directing element is arranged in the inflow zone 5 of each of the bores 4*a,* such that it cannot perform an axial movement relative to the bore 4*a* in question, nor a rotational movement about the respective longitudinal axis of the bore. The directing elements are preferably attached in the bores 4*a* completely rigidly. A different example embodiment for an individual directing element is shown for the same bore 4*a* in each of FIGS. 5 to 7. In the example embodiment in FIG. 5, a plane piece of sheet metal or a thin plate forms the directing element 6 in the manner of a peen. The directing element 6 points parallel to the longitudinal axis of the bore 4*a* and protrudes from the wall of the bore to the central longitudinal axis of the bore 4*a*.

In the example embodiment in FIG. 6, a multi-finned directing element 7 is formed by three peen-like metal sheets or thin plates which project outwards up to the wall of the bore from a common center which is coincident with the central longitudinal axis of the bore 4*a,* and which each enclose an angle of 120° in between. The cross-section of the bore 4*a* is sub-divided into three sectors in the inflow zone 5 by the directing element 7. The three fins of the directing element 7 are identically shaped and like the directing element 6 of the first example embodiment are plane-parallel with the longitudinal axis of the bore 4*a*. The directing element 7 is also inserted into the bore 4*a* from the inflow side, and additionally attached as the case may be, such that it can be neither shifted not rotated relative to the bore 4*a*.

FIG. 7 shows a directing element 8 in accordance with a third example embodiment. The directing element 8 is likewise formed by a thin plate or a metal sheet and is arranged in the bore 4*a*, plane-parallel with the longitudinal axis of the bore 4*a*, secured against shifting and rotating. Its width corresponds to the diameter of the bore 4*a*, such that it sub-divides the bore 4*a* into two identical segment halves, in the inflow zone 5.

The lengths $l_6$, $l_7$ and $l_8$ of the directing elements 6, 7 and 8, measured in the axial direction, are each proportioned such that the thermal treatment fluid no longer exhibits any practically relevant circumferential velocity component relative to the bore 4*a* when as it enters the free flow cross-section of the bore 4*a* at the downstream end of the respective directing element 6, 7 and 8. The length of the respective inflow zone 5 corresponds in the sense of the invention to the length of the directing element used. The directing elements 6, 7 and 8 are shaped and exhibit surfaces such that they offers the flowing thermal treatment fluid as little resistance as possible in the axial direction. With respect to the circumferential component $v_t$ of the flow velocity, they form impact bodies on which the thermal treatment fluid is slowed down and is carried along by the rotational movement which each of the bores 4*a* experiences as a result of the rotation of the roller body 2 and performs relative to the flow of the thermal treatment fluid which is substantially only axial here.

Figure 8:
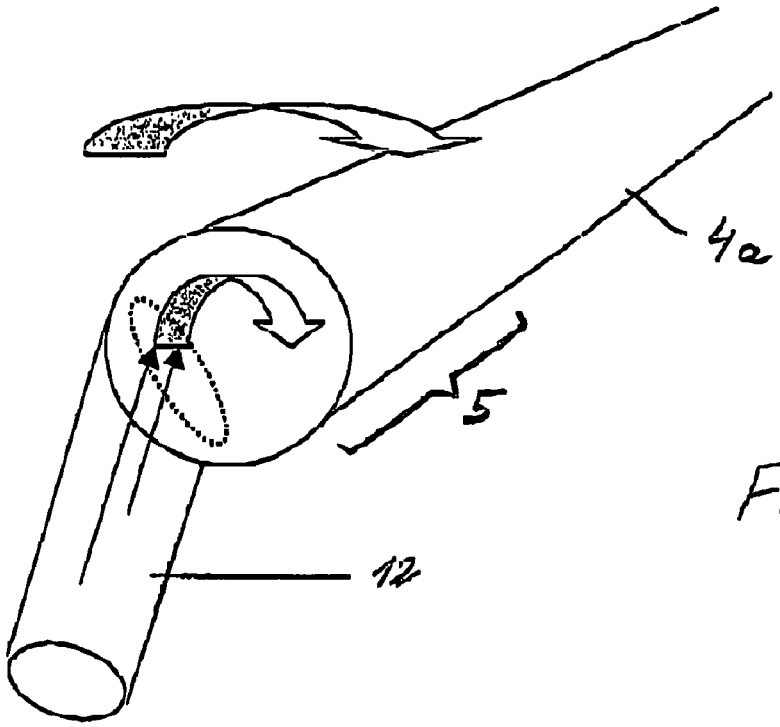
FIG. 8 an inflow zone of a peripheral bore in which a directing means is formed by shaping how the flow of fluid enters the bore in a particular way.

FIG. 8 shows another embodiment of a directing means. Here, a feed channel 12 which feeds into the bore 4*a* at the upstream end of the bore 4*a* is arranged with respect to the inflow zone 5 such that the flow of fluid does not enter the inflow zone 5 of the bore 4*a* symmetrically with respect to the bore 4*a*. By flowing onto the wall of the bore 4*a* laterally offset, i.e. eccentrically, the thermal treatment fluid is offset into a twist which ideally corresponds to the rotational movement of the roller body. Such a fluid entrance is formed for each of the bores 4*a* of the inflow side. This embodiment of a directing means does however require the inflow velocity to be adapted to the rotational velocity of the roller.

Figure 9:
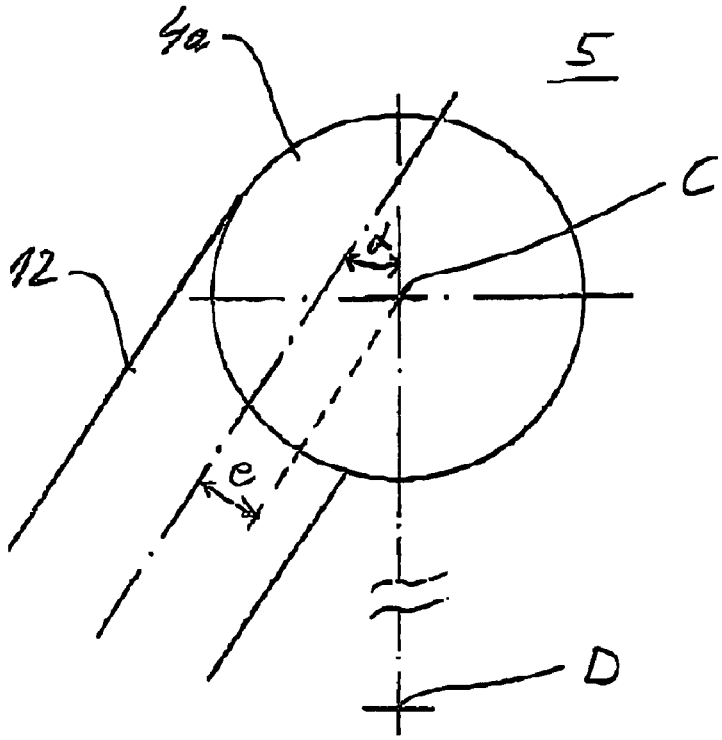
FIG. 9 the inflow zone in FIG. 8, in a cross-section.

FIG. 9 shows the inflow zone 5 of the bore 4*a* in FIG. 8, in a cross-section through the central longitudinal axis C of the feed channel 12. The feed channel 12 is formed in one of the flange trunnions—in the example embodiment in FIG. 2, in the flange trunnion 3*a*—such that the flow of fluid entering the bore 4*a* through the feed channel 12 flows into the bore 4*a* eccentrically, with an eccentricity e and at an inclination $\alpha$. The eccentricity e is measured between the central longitudinal axis C of the bore 4*a* and a central axis of the flow of fluid in the port. The inclination $\alpha$ is with respect to an axial/radial plane through which the rotational axis D of the roller and the central longitudinal axis C of the thermal treatment channel 4*a* extend. In principle, it would be sufficient for suppressing the relative channel swirl if the entering flow of fluid exhibits no inclination with respect to this plane but merely flows in eccentrically parallel. Similarly, it would be sufficient if the entering flow of fluid flows in centered on the longitudinal axis C of the thermal treatment channel 4*a* but with an inclination $\alpha$ with respect to the axial/radial plane cited.

In the foregoing description, preferred embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A roller for the thermomechanical treatment of a web-shaped medium, said roller including:

a) a roller body;

b) axial bores for a thermal treatment fluid which are incorporated in said roller body near to an outer surface of the roller body and into which said thermal treatment fluid flows on an inflow side;

c) inflow zones, formed on said inflow side in the upstream ends of said bores or in feed channels through which the thermal treatment fluid flows into the bores, each inflow zone extending in a flow direction over at most up to 20% of an overall length of the respective bore;

d) and directing or guiding means provided in said inflow zones, which transfer a rotational movement of said roller onto the thermal treatment fluid, said directing or guiding means extending only over the length of the respective inflow zone, wherein e) said directing means at least substantially completely transfer said rotational movement onto the thermal treatment fluid and in this way suppress a relative channel swirl between the bores and the thermal treatment fluid, while still in the inflow zones.

2. The roller as set forth in claim 1, wherein directing or guiding elements which protrude into the flowing thermal treatment fluid in the inflow zones form or form a part of the directing means.

3. The roller as set forth in claim 2, wherein said directing elements are arranged in the bores.

4. The roller as set forth in claim 2, wherein the directing elements are inserted into the bores or in the feed channels leading to the thermal treatment channels and are attached, secured against rotating and shifting.

5. The roller as set forth in claim 2, wherein the directing elements extend in the translational direction of the flowing thermal treatment fluid and obliquely to the rotational direction of the roller.

6. The roller as set forth in claim 2, wherein the directing elements form peens which in the bores or in the feed channels leading to the bores reach as far as the walls of the bores or feed channels.

7. The roller as set forth in claim 2, wherein the directing elements in the inflow zones sub-divide the bores or the feed channels leading to the bores into sectors or/and segments.

8. The roller as set forth in claim 1, wherein a feed channel feeds into one of the bores on the inflow side, such that a flow of fluid with an eccentricity enters the bore through the feed channel, in order to form the directing means.

9. The roller as set forth in claim 1, wherein a feed channel feeds into one of the bores on the inflow side, such that a flow of fluid entering the bore through the feed channel exhibits an inclination with respect to a plane through which the rotational axis of the roller and a central longitudinal axis of the bore extend, in order to form the directing means.

* * * * *